US005212837A

United States Patent [19]

Gose et al.

[11] Patent Number: 5,212,837

[45] Date of Patent: May 25, 1993

[54] PROTECTIVE CLOTHING ACCESSORY

[76] Inventors: Richard V. Gose; Kenneth W. Anderson, both of Suite 415, 500 South Main, Las Cruces, N. Mex. 88004

[21] Appl. No.: 759,993

[22] Filed: Sep. 13, 1991

Related U.S. Application Data

[63] Continuation-in-part of Ser. No. 646,209, Jan. 28, 1991.

[51] Int. Cl.[5] ..... A42B 1/06; A42B 3/04

[52] U.S. Cl. ..... 2/172; 2/2; 2/185 R; 2/199

[58] Field of Search ..... 2/2, 84, 171, 172, 185 R, 2/199, 202, 206, 207, 425, 94, DIG. 7

[56] References Cited

U.S. PATENT DOCUMENTS

| | | | |
|---|---|---|---|
| 34,538 | 2/1862 | Warburton | 2/172 X |
| 946,770 | 1/1910 | Sands | 2/172 X |
| 1,081,333 | 12/1913 | Reese | 2/172 |
| 2,055,560 | 9/1936 | Rose | 2/172 X |
| 2,192,341 | 3/1940 | Dahlberg | 2/172 X |
| 2,767,404 | 10/1956 | Collins | 2/171 X |
| 2,856,607 | 10/1958 | Richardson | 2/172 |
| 2,897,510 | 8/1959 | Forbes et al. | 2/172 |
| 3,014,221 | 12/1961 | Brunetto | 2/84 X |
| 3,205,508 | 9/1965 | Cox | 2/172 X |
| 4,180,868 | 1/1980 | Snow | 2/172 X |
| 4,602,385 | 7/1986 | Warren | 2/2.5 X |
| 4,975,980 | 12/1990 | Ersteniuk | 2/172 X |
| 4,980,928 | 1/1991 | Ellis | 2/185 X |
| 5,046,195 | 9/1991 | Koritan | 2/172 |
| 5,081,717 | 1/1992 | Shedd et al. | 2/199 |
| 5,091,996 | 3/1992 | Kirby | 2/171 X |

FOREIGN PATENT DOCUMENTS

| | | | |
|---|---|---|---|
| 139164 | 2/1929 | Switzerland | 2/172 |

*Primary Examiner*—Clifford D. Crowder
*Assistant Examiner*—Jeanette E. Chapman
*Attorney, Agent, or Firm*—Cushman, Darby & Cushman

[57] ABSTRACT

A protective clothing accessory to be worn with a headband, the accessory being designed to protect the neck and face of the wearer. The accessory is a fabric having a high tensile strength which can be selectively positioned to cover the face and neck of the wearer. Fastening means are disposed on the accessory to attach the accessory to a detached headband or to a headband of a headgear.

7 Claims, 2 Drawing Sheets

PROTECTIVE CLOTHING ACCESSORY

CROSS REFERENCE TO RELATED APPLICATIONS

This application is a continuation in part of application Ser. No. 07/646,209 filed Jan. 28, 1991, which was abandoned upon the filing hereof.

BACKGROUND OF THE INVENTION

1. Field of the Invention

This invention relates to a clothing accessory worn for protection of the neck and face of the wearer from a myriad of weather conditions, from windblown particulate matter and against sunburn, sunstroke and the like. More particularly, this invention is intended for use in a desert or beach environment and is particularly suited for use in a desert combat situation where the wearer also is exposed to projectiles.

2. Description of the Prior Art

Humans working and playing outdoors have long been exposed to the cruelties of Mother Nature and the vicious elements of the weather. For centuries, people have worn lightweight headgear such as the garments worn by shepherds herding their flocks and the headgear worn by desert travelers, such as the headdresses seen worn by the Bedouin in "Lawrence of Arabia".

However, these previous headdresses, while protecting the wearer from the elements, are ineffective in protecting the wearer from projectiles, such as shrapnel. In a combat situation, it is desirable to protect soldiers from both the elements and projectiles.

The prior art also has the disadvantage of not being transferable from hat to helmet. That is, the known headdresses can not be used in combination with different hats and assorted headgear.

SUMMARY OF THE INVENTION

The present invention overcomes the foregoing problems by providing a protective clothing accessory made of a material that functions not only to shield the wearer from the weather, but also to aid in resisting the penetration of projectiles such as shrapnel.

The accessory includes a fabric having a high tensile strength, such as "KEVLAR", equipped with assorted fastening means for positioning it about the face, neck and shoulders. The fastening means are preferably formed from a material such as "VELCRO", but other possibilities exist, such as snaps, hooks and zippers, to name a few.

The invention may be attached to a detached headband or to a headband affixed in headgear, such as a combat helmet.

When attached to either type of headband, the accessory is shaped so as to dangle around the wearer's neck and shoulders. The fastening means allows the fabric to be secured about the wearer's chest, neck or face to protect against the elements, from windblown particulate matter or projectiles.

BRIEF DESCRIPTION OF THE DRAWINGS

Other objects, features, and characteristics of the present invention, as well as the functions of the related elements of the structure, will become apparent upon consideration of the following description and the appended claims with reference to the accompanying drawings, all of which form a part of this specification and wherein like reference numerals designate corresponding parts in the various figures.

DETAILED DESCRIPTION OF THE PRESENTLY PREFERRED EXEMPLARY EMBODIMENT

Figure 1:
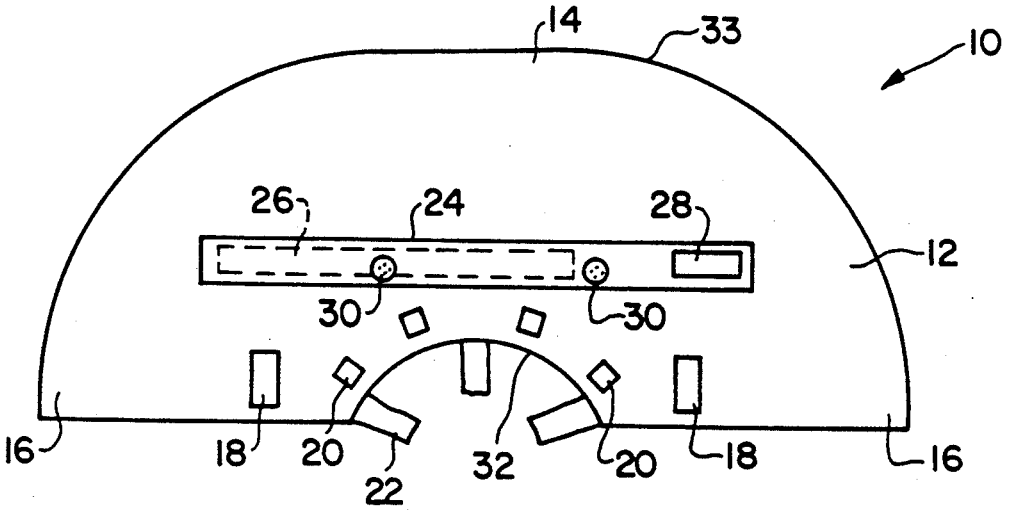
FIG. 1 depicts the exterior side of the present invention.
Figure 2:
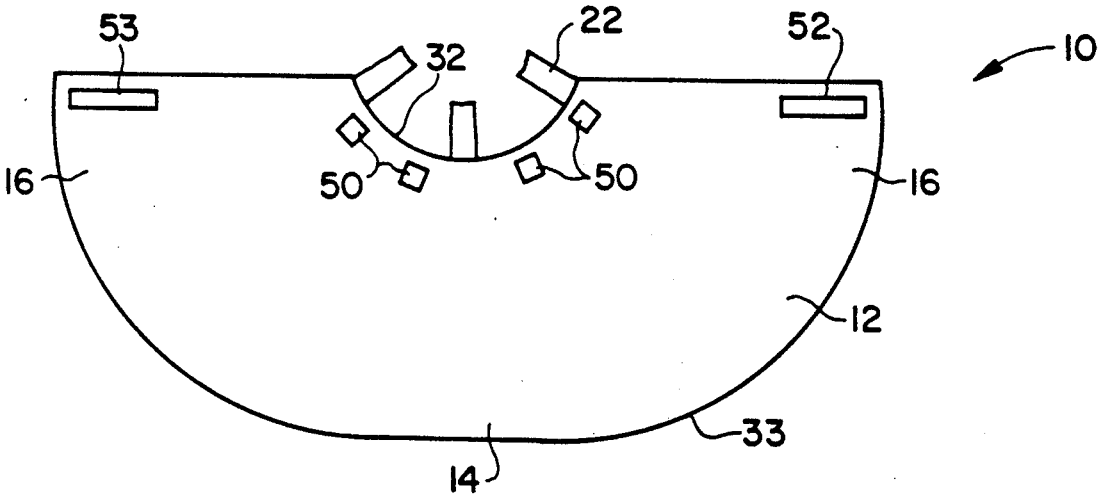
FIG. 2 illustrates the interior side thereof.

The protective clothing accessory according to the present invention is shown generally at 10 in FIGS. 1 and 2. The accessory includes a substantially semi-circular piece of fabric 12 having substantially parallel arcuately shaped edges 32 and 33 defining its configuration. The fabric includes various areas, which cover specific body parts. More particularly, central portion 14 covers the back of one's neck and shoulders when the invention is worn. The corner edges 16 drape down and cover the wearer's breasts when the accessory is hanging loosely.

The accessory 10 preferably is made of a high tensile strength material, such as "KEVLAR". Using a material with a high tensile strength enables the garment to protect the wearer from projectiles, such as shrapnel, and from other particulate matter, such as sand and dust. The, high tensile strength of the material also causes the fabric to be more durable, thus withstanding tears.

The present invention may be worn with or without other headgear. If the headgear has a distinct headband, such as a military helmet, the present invention can be attached to the headband by fasteners 20 or tabs 22. The fasteners 20 and tabs 22 are sewn or otherwise joined along the arcuately shaped edge 32 of fabric 12. Tabs 22 are lightweight flexible pieces each having fastening means at its end so that each tab may be separately secured to the headband.

When fabric 12 is secured to a headband and the headgear is worn, the fabric 12 drapes down about one's shoulders as previously described. The corners edges 16 of the fabric are provided with fastening elements 52 and 53 on the interior side of the fabric (FIG. 2). If the wearer desires to fasten the accessory so as to protect his face, a corner edge 16 is displaced so as to move a respective element 52, 53 into cooperative operative relationship with one of additional fasteners 18 secured to the exterior side of the fabric adjacent edge 32.

Figure 4:
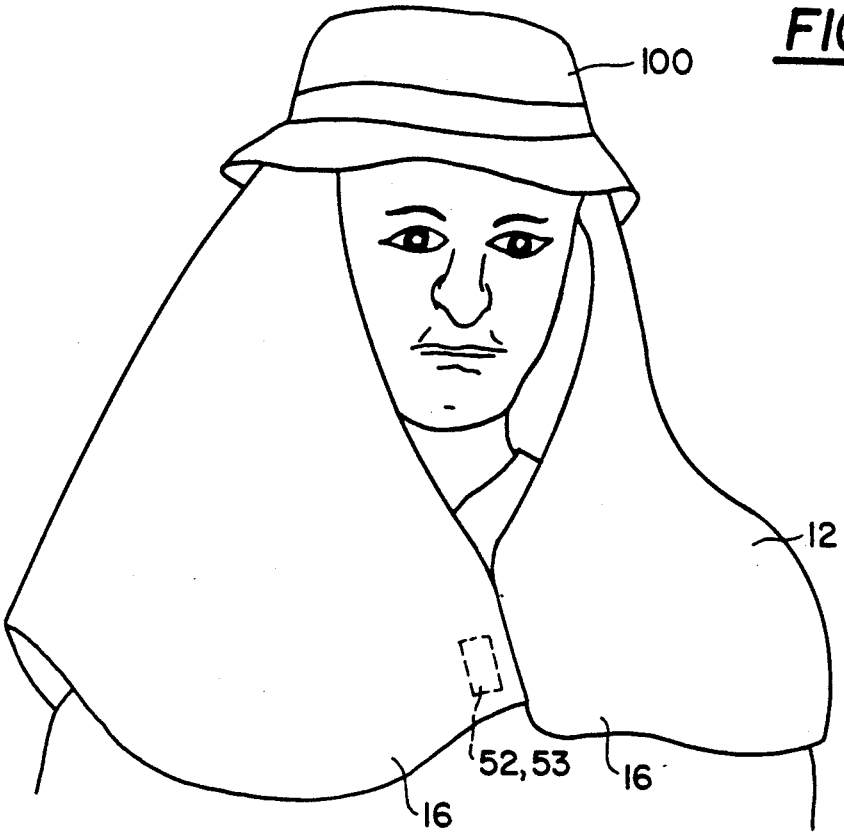
FIG. 4 displays the present invention secured to the headband shown in FIG. 3 and positioned on the head of a wearer.

Alternatively, the accessory 10 may be closed loosely in the front by joining the fastener elements 52 and 53 (FIG. 4). This allows the accessory 10 to be worn in a loose manner facilitating ventilation.

To permit the wearer to tighten the accessory 10 about the neck, strap 24 is disposed on the exterior side of the fabric at a central location between edges 32 and 33 (FIG. 1). Strap 24 is joined to fabric 12 using buttons 30 that are positioned on fabric 12 so as to allow the ends of strap 24 to be loose. It also is possible to use snaps, "VELCRO" or other known joining means instead of buttons. Complementary fastening elements 26 and 28, such as "VELCRO" strips, are secured to respective free ends of the strap 24 on opposite sides thereof. Thus, when a wearer wishes to tighten the accessory 10 about his neck, the ends of strap 24 are displaced so that fastener 26 connects with fastener 28.

Figure 3:
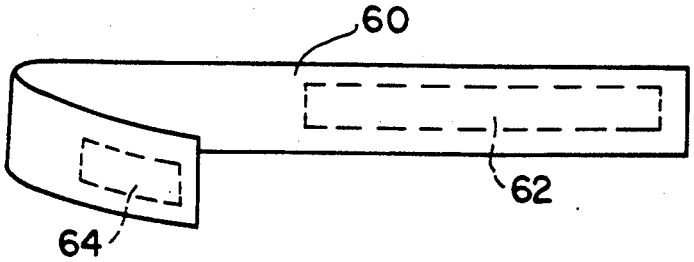
FIG. 3 shows a detached headband used in combination with the present invention.

As previously mentioned, it is possible to wear the clothing accessory independently of headgear having a headband suitable for attaching fasteners 20 or tabs 22 thereto. When the wearer wishes to so wear the accessory 10, a detached headband 60 (FIG. 3) is used to secure the accessory 10 to the wearer's head. Strap 24 also may be detached from the fabric and used as a headband. Like strap 24, headband 60 is provided with fastening elements 62 and 64, such as "VELCRO", secured to respective ends of the headband on opposite sides thereof. For the reasons hereinafter to be explained, strip 62 has a length approximately that of edge 32 of the fabric.

To wear the accessory with headband 60, it is preferable to first secure the headband about the head, usually just above the level of the eyes. This is done by wrapping band 60 around the head with fastener 62 facing outwardly. Fastener 64 then is connected with fastener 62 in a manner such that headband 60 fits the wearer's head snugly. Fabric 12 next is joined to headband 60 by attaching interior fasteners 50, located adjacent edge 32, to the remaining exposed area of fastener 62 on the head band. When so secured to the headband, fabric 12 hangs down around the shoulders and chest in a manner similar to when tabs 22 are used to attach the accessory 10 to the headband of a headgear.

Of course, if strap 24 is used as a headband, fabric 12 is secured to the strap in a fashion similar to that just described.

FIG. 4 illustrates how the accessory appears when secured to headband 60. The drawing further illustrates a hat 100, having no headband suitable for attachment to fasteners 20 or tabs 22, being worn to provide further head coverage. In FIG. 4, the wearer has joined fastener elements 52 and 53 of the accessory 10.

Figure 5:
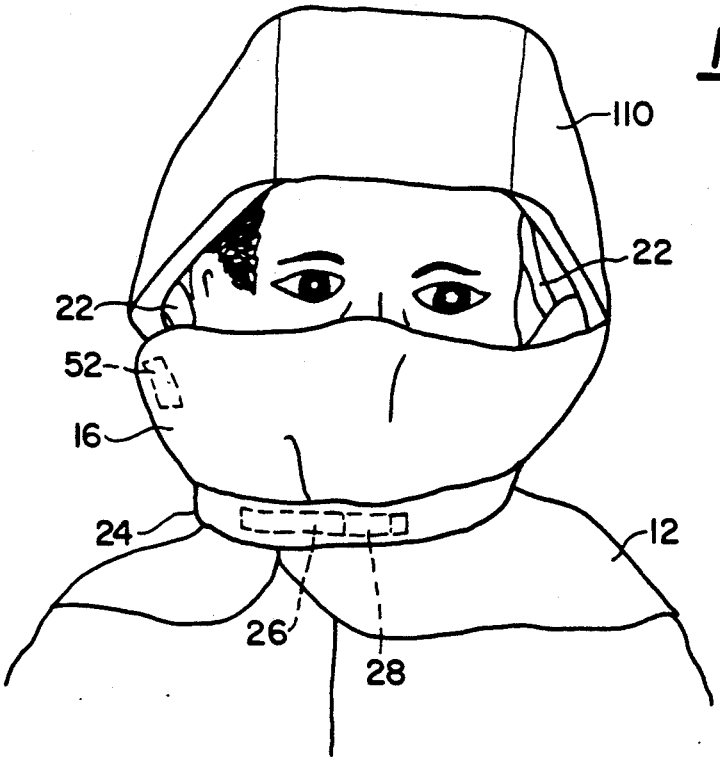
FIG. 5 illustrates the present invention attached to an interior headband of a headgear and positioned on the head of a wearer.

FIG. 5 illustrates the accessory 12 worn so that fasteners 20 or tabs 22 are attached to an interior headband of headgear such as a military helmet 110. In this depiction, the wearer has secured fastener 52 so that his nose and mouth are shielded. To further tighten fabric 12 about his neck, the wearer has joined fasteners 26 and 28 of strap 24. Wearing the accessory in such a manner provides the maximum amount of protection from the elements, windblown objects and projectiles.

The present invention is especially suitable for military use. Accordingly, the fabric 12 may be colored in a camouflage motif. Such a motif may be dark green camouflage for jungle operations or a beige colored camouflage for desert operations. Of course, the coloration is not limited to camouflage. For bright sunlight, lighter colors are preferred for reflecting the light.

The invention has been described in connection with what are presently considered to be the most practical and preferred embodiments. However, it is to be understood that the invention is not to be limited to the disclosed embodiments, but on the contrary, is intended to cover various modifications and equivalent arrangements included within the spirit and scope of the appended claims.

What is claimed is:

1. A clothing accessory for protecting the neck and face of a wearer and adapted to be secured to a headband, said accessory comprising:

a substantially semi-circular piece of fabric having interior and exterior sides and substantially parallel arcuately shaped opposed edges, wherein one of said edges has a lesser radius than the other of said edges;

first fastening means joined to one of said sides of the fabric along said edge having a lesser radius, said fastening means being adapted to be secured to a headband which is secured to and forms a part of a headgear; and second fastening means disposed on the other of said sides of the fabric adjacent said edge having a lesser radius, said additional fastening means being adapted to be secured to a headband which is independent of a headgear.

2. A clothing accessory as claimed in claim 1, further comprising first and second fastener elements respectively connected to said interior side of the fabric at opposite ends of the edge having a greater radius, said fastener elements being adapted to be secured to each other.

3. A clothing accessory as claimed in claim 2, wherein said fabric is a material having an enhanced tensile strength.

4. A clothing accessory as claimed in claim 2, wherein said first and second fastener elements are respectively connected to said interior side of the fabric at opposite ends of the edge having a greater radius, said fastener elements being adapted to be secured to each other and at least one of said fastener elements being adapted to be secured to an additional fastener element disposed on the exterior side of the fabric adjacent an end of the edge having a lesser radius.

5. A clothing accessory as claimed in claims 1 or 4, further comprising an adjustable neck strap disposed on said exterior side of said fabric for permitting the wearer to secure the accessory around the neck.

6. A clothing accessory as claimed in claim 5, wherein said fabric is a material having an enhanced tensile strength.

7. A clothing accessory as claimed in claims 1 or 4, wherein said fabric is a material having an enhanced tensile strength.

* * * * *